US009453393B2

(12) United States Patent
Mullins

(10) Patent No.: US 9,453,393 B2
(45) Date of Patent: Sep. 27, 2016

(54) APPARATUS AND METHOD FOR SETTING A LINER

(71) Applicant: Seminole Services, LLC, Houston, TX (US)

(72) Inventor: Frank Mullins, Houston, TX (US)

(73) Assignee: Seminole Services, LLC, The Woodlands, TX (US)

( * ) Notice: Subject to any disclaimer, the term of this patent is extended or adjusted under 35 U.S.C. 154(b) by 379 days.

(21) Appl. No.: 14/161,300

(22) Filed: Jan. 22, 2014

(65) Prior Publication Data

US 2015/0204144 A1 Jul. 23, 2015

(51) Int. Cl.
*E21B 43/10* (2006.01)

(52) U.S. Cl.
CPC ..... *E21B 43/10* (2013.01); *E21B 43/103* (2013.01); *E21B 43/105* (2013.01)

(58) Field of Classification Search
USPC ..... 166/382, 285, 177.4, 208
See application file for complete search history.

(56) References Cited

U.S. PATENT DOCUMENTS

| | | | |
|---|---|---|---|
| 3,067,819 | A | 12/1962 | Gore |
| 3,130,987 | A | 4/1964 | Johnson |
| 3,186,485 | A | 6/1965 | Owen |
| 3,191,677 | A | 6/1965 | Kinley |
| 3,245,471 | A | 4/1966 | Howard |
| 3,412,565 | A | 11/1968 | Lindsey |
| 3,419,080 | A | 12/1968 | Lebourg |
| 3,568,773 | A | 3/1971 | Chancellor et al. |
| 3,712,376 | A | 1/1973 | Owen et al. |
| 3,746,091 | A | 7/1973 | Owen et al. |
| 3,776,307 | A | 12/1973 | Young |
| 3,948,321 | A | 4/1976 | Owen et al. |
| 4,495,997 | A | 1/1985 | Scott et al. |
| 4,595,058 | A | 6/1986 | Nations |
| 4,848,469 | A | 7/1989 | Baugh et al. |
| 4,971,152 | A | 11/1990 | Koster et al. |
| 4,976,322 | A | 12/1990 | Abdrakhmanov et al. |

(Continued)

FOREIGN PATENT DOCUMENTS

| | | |
|---|---|---|
| WO | WO 99/35368 A1 | 7/1999 |
| WO | WO 00/37766 A3 | 6/2000 |

(Continued)

OTHER PUBLICATIONS

Andrei Filippov, Robert Mack, Shell; Lance Cook, Patrick York, Lev Ring, Enventure Global Technology; Terry McCoy, Haliburton Energy Services; "Expandable Tubular Solution", SPE Annual Conference and Exhibition, 1999, Houston, Texas.

(Continued)

*Primary Examiner* — Taras P Bemko
(74) *Attorney, Agent, or Firm* — Jones Walker LLP

(57) ABSTRACT

An apparatus for setting a liner in a wellbore that includes a setting tool attached to a work string. The setting tool includes a stretching mandrel and a liner top releasably attached to the setting tool. The liner top includes banded elastomer sheaths positioned in multiple locations along its length. The apparatus may also include a roller screw, operatively attached to the setting tool, so that a rotational movement imparted to the work string causes a forward, rotational movement of the stretching mandrel and engages the stretching mandrel with an inner portion of the liner top so that a protuberance is formed on the inner portion of the liner top and a groove is formed on an outer surface of the liner top.

9 Claims, 13 Drawing Sheets

Fig. 4

(56) References Cited

U.S. PATENT DOCUMENTS

| | | | |
|---|---|---|---|
| 5,074,362 | A | 12/1991 | Allwin |
| 5,074,608 | A | 12/1991 | Gabriel |
| 5,119,661 | A | 6/1992 | Abdrakhmanov et al. |
| 5,348,095 | A | 9/1994 | Worrall et al. |
| 5,366,012 | A | 11/1994 | Lohbeck |
| 5,667,011 | A | 9/1997 | Gill et al. |
| 5,667,252 | A | 9/1997 | Schafer et al. |
| 6,098,717 | A | 8/2000 | Bailey et al. |
| 6,253,846 | B1 | 7/2001 | Nazzai et al. |
| 6,276,690 | B1 | 8/2001 | Gazewood |
| 6,415,863 | B1 | 7/2002 | Hudson et al. |
| 6,446,724 | B2 | 9/2002 | Baugh et al. |
| 6,454,493 | B1 | 9/2002 | Lohbeck |
| 6,457,532 | B1 | 10/2002 | Simpson |
| 6,497,289 | B1 | 12/2002 | Cook et al. |
| 6,550,539 | B2 | 4/2003 | Maguire et al. |
| 6,598,677 | B1 | 7/2003 | Baugh et al. |
| 6,679,334 | B2 | 1/2004 | Johnson et al. |
| 6,722,441 | B2 | 4/2004 | Lauritzen et al. |
| 6,904,974 | B2 | 6/2005 | Slack |
| 6,997,266 | B2 | 2/2006 | Jackson et al. |
| 7,044,231 | B2 | 5/2006 | Doane et al. |
| 7,128,147 | B2 | 10/2006 | Marcin et al. |
| 7,228,896 | B2 | 6/2007 | Gazewood |
| 7,350,584 | B2 | 4/2008 | Simpson et al. |
| 7,360,592 | B2 | 4/2008 | McMahan |
| 7,798,536 | B2 | 9/2010 | Hashem et al. |
| 7,819,185 | B2 | 10/2010 | Shuster |
| 2001/0020532 | A1 | 9/2001 | Baugh et al. |
| 2003/0116325 | A1 | 6/2003 | Cook et al. |
| 2004/0134668 | A1 | 7/2004 | Mackay |
| 2005/0000697 | A1 | 1/2005 | Abercrombie Simpson et al. |
| 2005/0269108 | A1 | 12/2005 | Whanger et al. |
| 2009/0211770 | A1 | 8/2009 | Nutley et al. |
| 2011/0036560 | A1 | 2/2011 | Vail, III et al. |

FOREIGN PATENT DOCUMENTS

| | | | |
|---|---|---|---|
| WO | WO 00/77431 | A2 | 12/2000 |
| WO | WO 02/14645 | A1 | 2/2002 |
| WO | WO02/25056 | A1 | 3/2002 |

OTHER PUBLICATIONS

Eduardo Perez-Roca, Stacey Andrews, and Doug Keel, Enventure Global Technology, L.L.C.; "Addressing Common Drilling Challenges Using Solid Expandable Tubular Technology", SPE Asia Pacific Oil and Gas Conference and Exhibition, 2003, Jakarta, Indonesia.

B.O. Braddick, G.D. Jordan, S.F. Baker, and M.A. Stulberg, SPE TIW Corporation; "Development and Testing of an Expandable Casing Patch System", SPE/IADC Drilling Conference, 2005, Amsterdam, The Netherlands.

R.B. Stewart, SPE; F. Marketz, W.C.M. Lohbeck (SIEP); F.D. Fischer and W. Daves, Insitute of Mechanics, Monatanuniversität Leoben; F.G. Rammerstorfer and H.J. Böhm, Vienna University of Technology; "Expandable Wellbore Tubulars", SPE Technical Symposium, 1999, Dhahran, Saudi Arabia.

APPARATUS AND METHOD FOR SETTING A LINER

BACKGROUND OF THE INVENTION

This invention relates to a liner in a well. More specifically, but not by way of limitation, this invention relates to an apparatus and method of setting a liner in a wellbore containing a casing string.

In the process of drilling wells, an operator will run and set a series of casing strings. At some point, and due to different engineering and geological issues, a drilling or production casing liner may be desirable. An operator may set the casing liner into a bore hole, with the liner running from the bottom end of the already cemented-in-place intermediate casing string to the bottom of the open bore hole. In this way, the liner is not run all the way to surface. The top portion of the casing liner will be attached to the already cemented-in-place intermediate casing string.

SUMMARY OF THE INVENTION

An apparatus for setting a liner in an existing casing string, wherein the apparatus is attached to a work string placed in the wellbore. The apparatus comprises a setting tool attached to the work string, with the setting tool having connected thereto a stretching mandrel having an outer portion, the liner top releasably attached to the setting tool, with the liner top containing a banded elastomer sheath positioned about the top liner, and wherein the stretching mandrel being concentrically placed within the top liner. The apparatus may further include means, operatively attached to the setting tool, for generating axial movement of the stretching mandrel so that a rotational movement imparted to the work string causes a forward, rotational movement of the stretching mandrel thereby engaging the stretching mandrel with the inner portion of the liner top so that a protuberance is formed on an inner surface of the liner top and a groove on an outer surface of the liner top is formed, wherein the banded elastomer member fills the groove and sealingly engages and anchors with an inner surface of the intermediate casing string. The generating axial movement means may be a screw shaft having a proximal end attached to the work string and a distal end connected to the stretching mandrel. In one embodiment, the banded elastomer member contains a plurality of circumferential elastomers positioned about the top liner. Also in one disclosed embodiment, the stretching mandrel contains a helical wedge profile on the outer surface of the stretching mandrel so that as the stretching mandrel is moved axially in a forward (i.e. upward) direction, the groove formed by the helical wedge profile comprises a helical groove on the outer portion of the top liner and the protuberance formed by the helical wedge profile comprises a helical protuberance on the inner portion of the top liner. In yet another embodiment, the stretching mandrel includes a plurality of helical wedge profiles so that as the stretching mandrel is moved axially in a forward (i.e. upward) direction, the plurality of helical wedge profiles forms helical grooves on the outer portion of the top liner and a plurality of helical protuberances on the inner portion of the top liner.

In another embodiment, an apparatus for setting a liner in a wellbore is disclosed, with the apparatus attached to a work string placed in the wellbore. The apparatus includes a setting tool attached to the work string, with the setting tool having attached thereto a stretching mandrel having an outer portion; a liner top releasably attached to the setting tool at a proximal end and attached to the liner at a distal end, with the liner top containing a banded elastomer member positioned about the liner top, and wherein the stretching mandrel is concentrically placed within the top liner; a roller screw, operatively attached to the setting tool, with the roller screw having thread means so that a rotational movement imparted to the work string causes a forward, rotational movement of the stretching mandrel thereby engaging the stretching mandrel with the inner portion of said liner top so that a protuberance is formed on an inner surface of the top liner and a groove is formed on an outer surface of the top liner; wherein a variable extrusion gap is formed between the groove on the outer surface and the inner portion of the intermediate casing; and, wherein the elastomer band is force formed and molded into the extrusion gap and sealingly engages with the inner portion of the intermediate casing, thus allowing for concentrically sealing the casing strings which is necessary to seal off the newly drilled borehole. With this embodiment, a cementing tool connection may be attached to the distal end of the liner, with the cementing tool (liner wiper plug(set)) configured to deliver a cementing slurry to the wellbore.

A method of sealing a liner to a casing, wherein the casing is positioned within a wellbore and a work string is concentrically placed within the wellbore, is also disclosed. The method comprises providing an apparatus concentrically placed within the casing, with the apparatus including a setting tool attached to the work string, with the setting tool having attached thereto a stretching mandrel; a liner top releasably attached to the setting tool, the liner top containing a banded elastomer positioned about the liner top, and wherein the stretching mandrel is concentrically placed within the liner top; a roller screw, operatively attached to the work string, the roller screw having thread means so that a torque imparted to the work string causes a forward, rotational movement of the stretching mandrel which forms a helical groove on an outer surface of the liner top. The method may comprise releasing the setting tool from the liner top. The method further includes rotating the work string so that the roller screw is rotated, moving the stretching mandrel forward (i.e. upward), creating a protuberance on the inner portion of the top liner with the wedge profile located on the stretching mandrel, forming the helical groove on the outer portion of the top liner; molding the banded elastomer into a variable extrusion gap formed between the inner portion of the casing and the helical groove on the outer portion of the liner top so that the molded elastomer sealingly engages with the inner portion of the casing; and, sealingly engaging the force formed and molded elastomer with the inner portion of the casing. In one embodiment, after the step of deploying the apparatus within the casing, the method includes: pumping a cement through the work string and through the apparatus so that the cement exits a distal end of the liner and cementing the wellbore by providing the cement to an annular area formed between the liner and the wellbore. After completion of cementing the liner and sealing the liner top to the intermediate casing, the method may include pulling the work string and attached setting tool out from the well.

In another embodiment, an apparatus for setting a liner in a wellbore. The apparatus may include a setting tool attached to the work string, with the setting tool having attached thereto a stretching mandrel containing a plurality of helical wedge profiles on the outer surface of said stretching mandrel. With this embodiment, the apparatus may include a top liner releasably attached to the setting tool, the liner top containing a banded elastomer member positioned about the top liner, and wherein the stretching mandrel is concentrically placed within the liner top, a screw shaft, operatively attached to the setting tool, for generating axial movement of the stretching mandrel so that a rotational movement imparted to the work string causes a forward, rotational movement of the stretching mandrel so that the wedge profiles form helical protuberances on the inner surface of the liner top and helical grooves are formed on an outer surface of the liner top which sealingly engages with an inner surface of the casing string, wherein the elastomer member flows into the helical grooves and engages with the inner portion of the casing string; and, power generating means, operatively attached to the screw shaft, for powering axial movement to the stretching mandrel along the screw shaft during rotational movement. The power generating means may be a planetary roller gear assembly.

In yet another embodiment, an apparatus for setting a liner in a wellbore. With this embodiment, the apparatus includes a setting tool attached to the work string, with the setting tool having attached thereto a stretching mandrel containing a plurality of helical wedge profiles on an outer surface of the stretching mandrel; a liner top releasably attached to the setting tool at a proximal end and attached to the liner at a distal end; a banded elastomer member positioned on an outer portion of the liner top; a slip band contained on the outer portion of the liner top; and a screw shaft, operatively attached to the setting tool, for generating axial movement of the stretching mandrel so that a rotational movement imparted to the work string causes a forward, rotational movement of the stretching mandrel so that the helical wedge profiles form a helical protuberance on an inner portion of the top liner and a helical groove are formed on the outer portion of the top liner which sealingly engages with an inner surface of the casing string, and the metallically formed slip band is forged and anchors with the inner surface of the casing string with the axial movement of the stretching mandrel. The apparatus may also include power generating means, operatively attached to the screw shaft, for powering axial movement to the stretching mandrel along the screw shaft during rotational movement. In one embodiment, the slip band may include a plurality of slip segments, staggeringly placed about the outer portion of the liner top.

In yet another method embodiment, a method of anchoring and sealing a liner to a casing is disclosed. The method includes providing an apparatus concentrically placed within the casing, the apparatus including: a setting tool attached to the work string, with the setting tool having attached thereto a stretching mandrel having helical wedge profile thereon; a top liner releasably attached to the setting tool at a proximal end and attached to the liner at a distal end, said top liner containing a banded elastomer positioned about an outer portion of the liner top and slips contained about the outer portion of the liner top, and wherein the stretching mandrel is concentrically placed within an inner portion of the top liner; a roller screw, operatively attached to the work string, with the roller screw having thread means so that a torque imparted to the work string causes a forward, rotational movement of the stretching mandrel which forms a helical groove on the outer portion of the top liner. The method may further comprise rotating the work string so that the roller screw is rotated, moving the stretching mandrel forward (i.e. upward), creating a protuberance on the inner portion of liner top with the helical wedge profiles, and forming (i.e. creating) helical grooves on the outer portion of the top liner. The method may also comprise of molding the banded elastomer into a variable extrusion gap formed between the inner portion of the casing and the helical groove on the outer portion of the top liner, sealingly engaging the force formed and molded elastomer with the inner portion of the casing, forcing the slips into the inner portion of the casing, and anchoring the metallically formed slips with the inner portion of the casing.

DETAILED DESCRIPTION OF THE PREFERRED EMBODIMENTS

Figure 1:
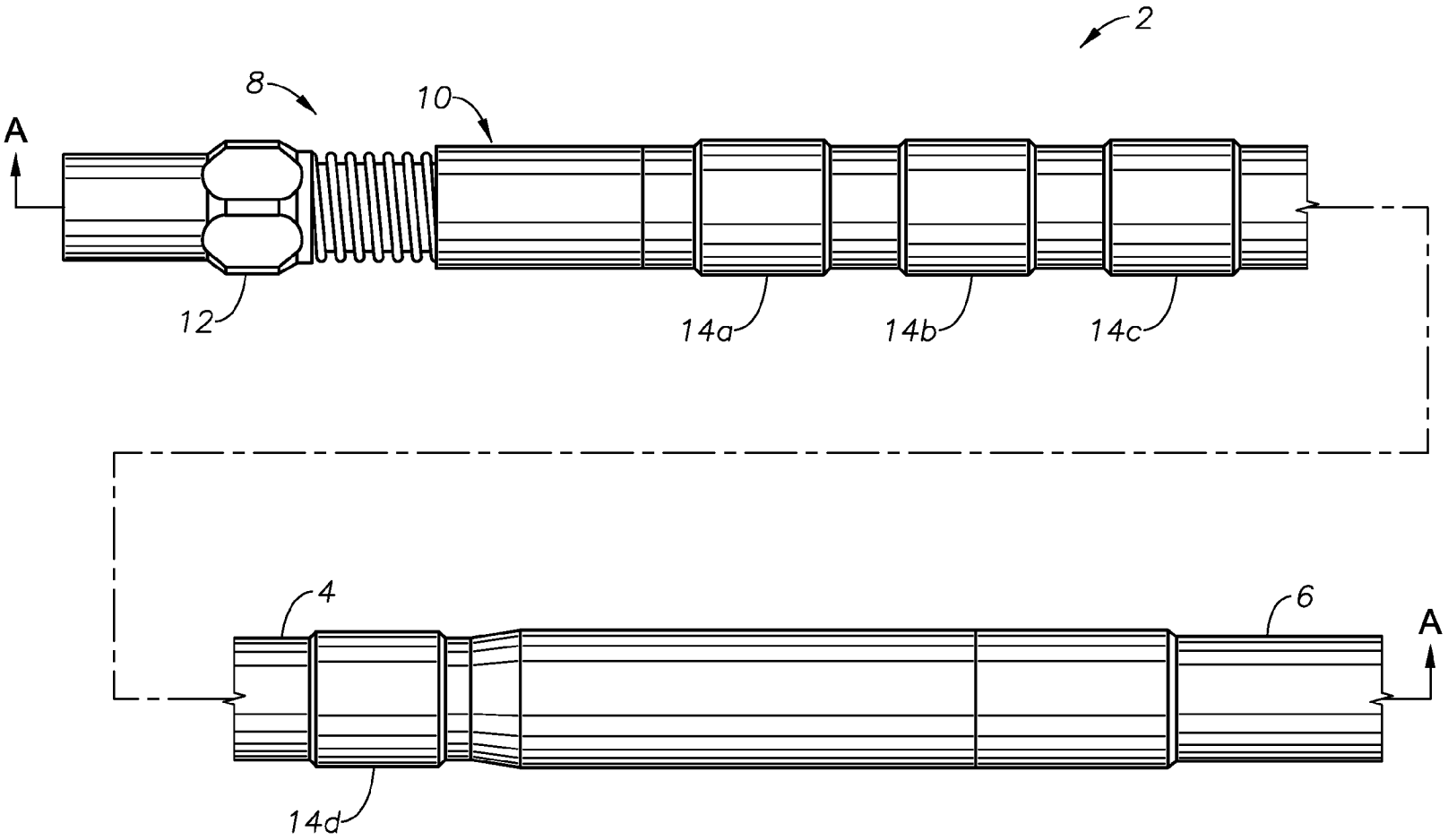
FIG. 1 is an illustration of one embodiment of the apparatus herein disclosed.

Referring now to FIG. 1, an illustration of one embodiment of the apparatus 2 herein disclosed. In FIG. 1, a liner top 4 is attached to a liner 6. The liner top 4 will be releasably attached to the setting tool, seen generally at 8. The setting tool 8 may contain a sliding sleeve assembly 10 for filtering entering drilling fluid. The filter incorporated into the sliding sleeve assembly is commercially available from Gerard Daniel under the name Wire Cloth and Wire Weave. The setting tool 8 may also contain a centralizer 12 for centralizing the apparatus 2 in the well. As seen in FIG. 1, the liner top 4 will contain a plurality of banded elastomer members 14*a*, 14*b*, 14*c*, 14*d*, wherein the banded elastomer members will be circumferentially placed about the liner top 4 for sealing with a casing string as will be more fully explained later in this disclosure. The banded elastomer members 14*a*, 14*b*, 14*c*, 14*d* may also be referred to as elastomer sheaths. Elastomer members are well known in the art and are commercially available from DuPont under the name Viton Fluoroelastomer.

Figure 2:
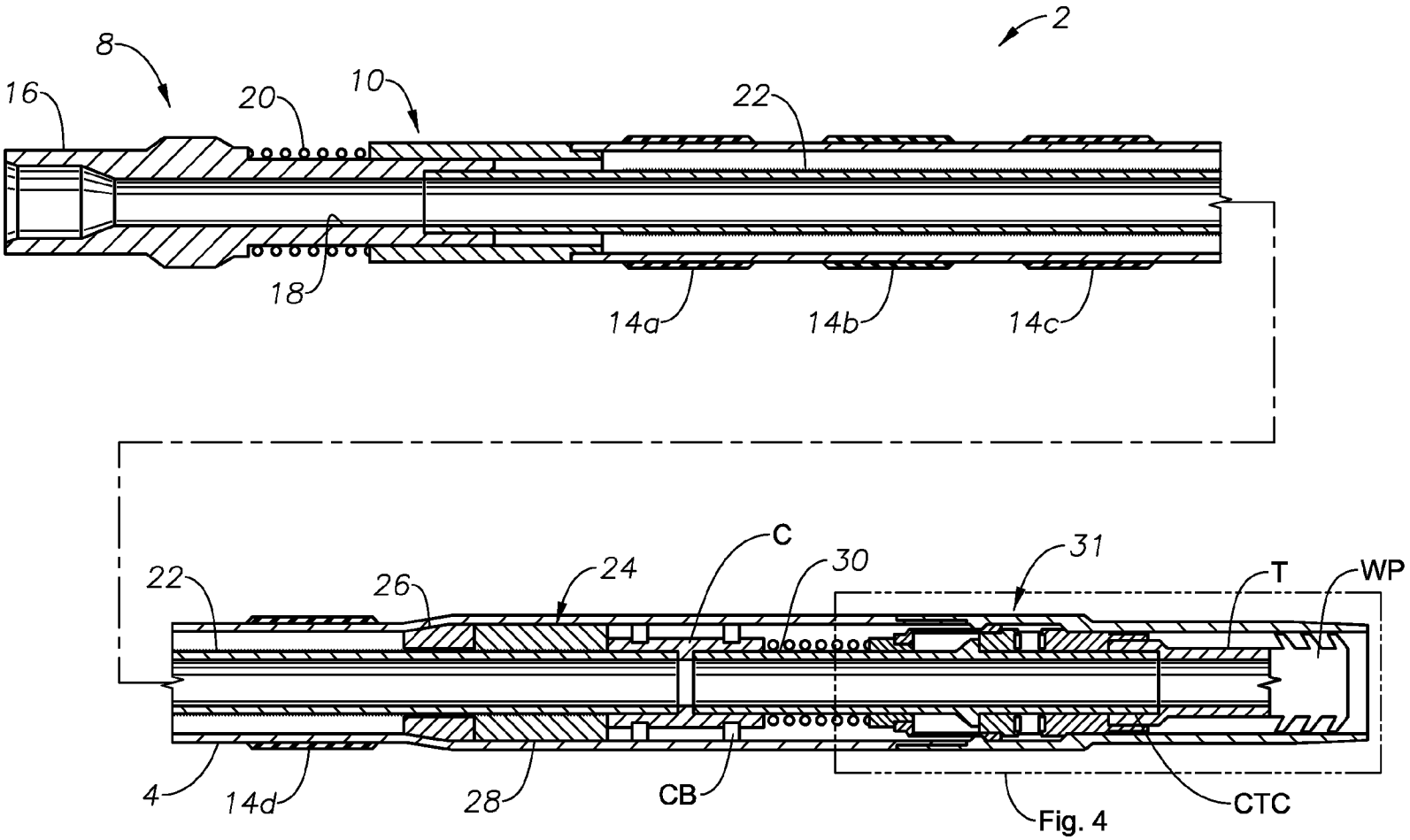
FIG. 2 is a cross-sectional view of the apparatus seen in FIG. 1 taken along line A-A of FIG. 1.

FIG. 2 is a cross-sectional view of one embodiment of the apparatus 2 seen in FIG. 1 taken along line A-A of FIG. 1. It should be noted that like numbers appearing in the various figures refer to like components. Referring to FIG. 2, the setting tool 8 includes a top sub 16 that includes an inner bore 18. The outer portion of the setting tool 8 includes the spring 20 that biases the sliding sleeve 10 against the liner top 4. FIG. 2 also illustrates the threaded shaft 22 which is threadedly attached to the top sub 16, wherein the threaded shaft 22 is attached to the stretching mandrel assembly seen generally at 24. The stretching mandrel assembly 24 includes the stretching mandrel 26 that is attached to planetary roller gear member 28 which in turn is attached to the threaded shaft 22. A thrust, bearing and release assembly 31 is attached to the lower shaft 30, and the lower shaft 30 is attached to a coupling "C", wherein the coupling "C" connects both the threaded shaft 22 and the lower shaft 30 together. A central bushing "CB" is contained on coupling C, wherein the central bushing CB stabilizes threaded shaft 22 during operation and reduces the risk of buckling. FIG. 2 also depicts the end of the shaft 30 which can be connected to a tool for cementing purposes, with the cementing tool connection shown generally at "CTC" and with the cementing tool shown schematically at "T". The cementing tool is operatively connected to a wiper plug "WP". As well understood by those of ordinary skill in the art, cementing tools include liner plug launchers, darts, and wiper plugs, which are used for cementing a liner, and are well known in the art and are commercially available from Allamon Tool Company under the name EZD Wiper Plug. Other cementing tools are also available from Weatherford International under the name Sub-Surface Release Small-Bore Plug System.

Figure 3:
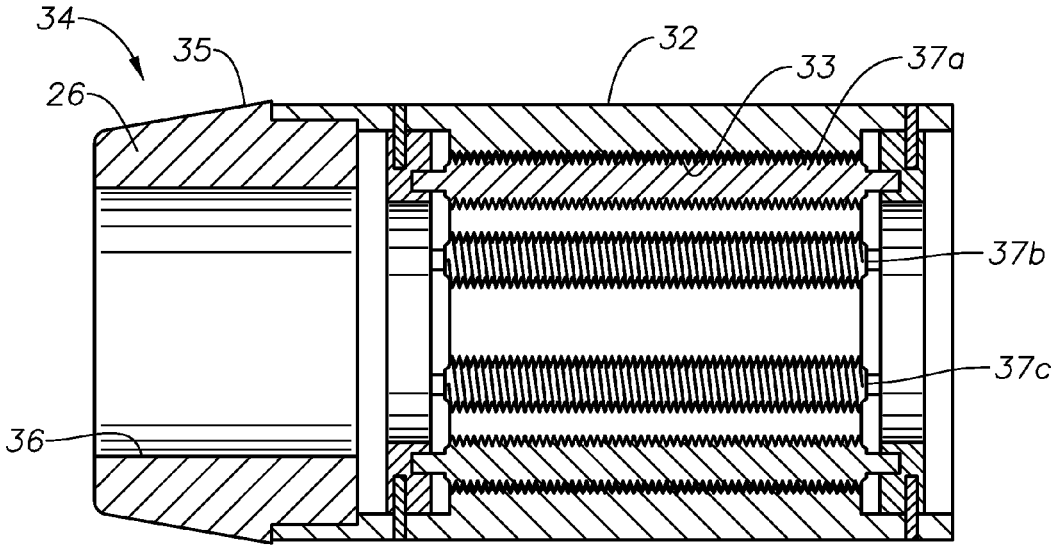
FIG. 3 is a cross-sectional view of the stretching mandrel and attached roller screw case housing with planetary roller gears.

FIG. 3 is a cross-sectional view of the stretching mandrel 26 and threadedly attached roller nut case housing 32, wherein the case housing 32 will have disposed within the threaded inner portion 33, planetary roller gear members. The stretching mandrel 26 contains an outer portion 34 that is generally an outer wedge shaped contour as well as an inner bore 36. The stretching mandrel 26 will be described in further detail later in this disclosure. FIG. 3 depicts the rollers of the planetary roller gear, for instance rollers 37*a*, 37*b*, 37*c*; wherein the rollers 37*a*, 37*b*, 37*c* will cooperate and rotate with the threaded inner portion 33, as well as the threaded shaft 22 (not seen in this view). The rotation from the shaft 22 will impart rotary motion on the roller members 37*a*, 37*b*, 37*c* being engaged with the threaded inner portion 33 of the roller nut case housing 32, thereby providing a transfer of rotary motion into linear motion.

Figure 4A:
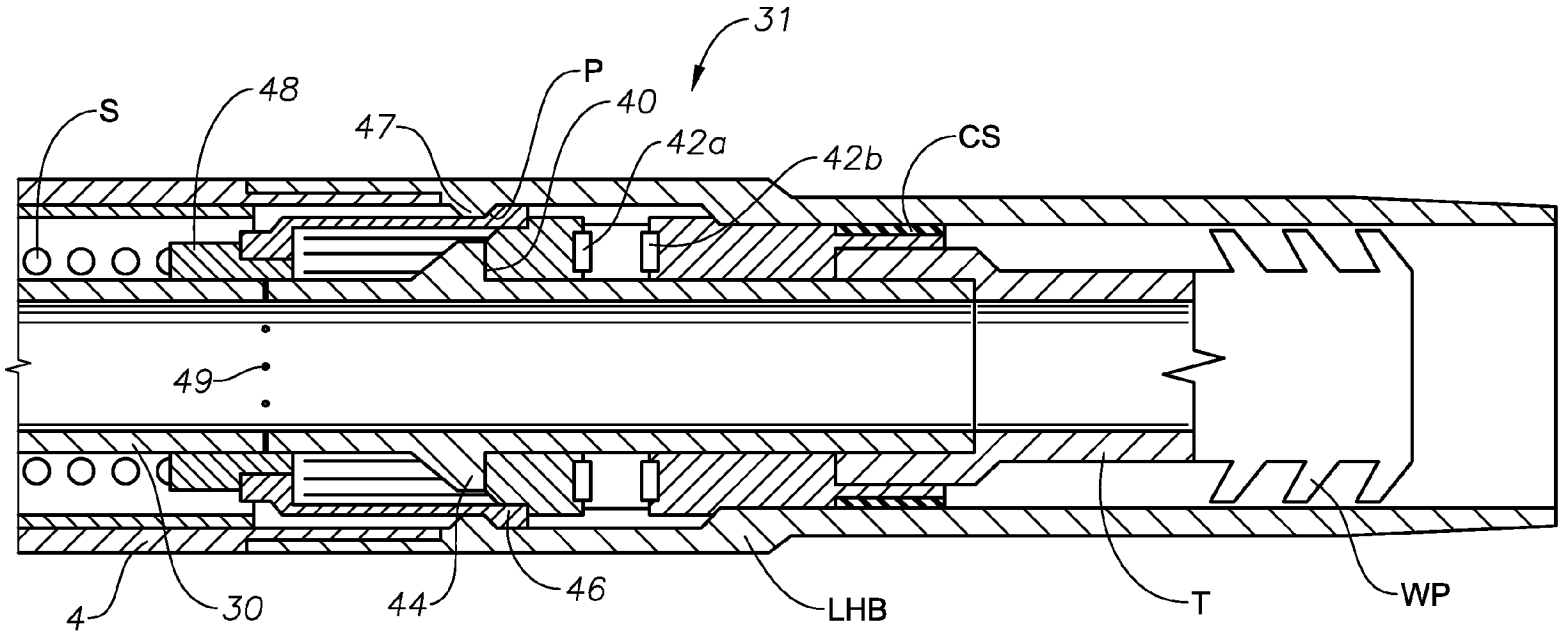
FIG. 4A is a thrust, bearing and release assembly of the detail "4" seen in FIG. 2 in the run in the well position.

Referring now to FIG. 4A, an enlarged view of the thrust, bearing, and release assembly 31 of detail "4" of FIG. 2 in the run in the well position will now be described. A segment of the lower shaft 30 forms part of the thrust, bearing and release assembly 31. In one embodiment, the thrust, bearing and release assembly 31 includes the thrust plate 40, bearing 42*a*, bearing 42*b*, and the enlarged outer tubular portion 44. The bearings 42*a* and 42*b* are commercially available from US Synthetic Bearings under the name Polycrystalline Diamond Bearings. The release mechanism of the thrust, bearings and release assembly 31 includes the collet assembly, seen generally at 46, that is operatively configured to releasably engage the profile "P" adjacent the notch 47 contained on the lower hanger body "LHB", which is an integral part in the liner top 4. A Chevron seal pack "CS" is also provided. Note that the lower hanger body LHB is a sub that is intermediate the liner top 4 and the liner 6. The profiles, such as profile "P", are an inner recess formed on an inner portion of the lower hanger body LHB. The spring "S" is shown. In one embodiment, the spring S resists pressure on the piston during cementing, plug launch, etc. The setting tool must have high pressure (higher than any other operation in setting/cementing a liner) as well as the setting tool being in compression for release to occur. In one embodiment, during run in, the tool may go into compression if the liner hits a tight spot, but as long as the pressure doesn't build to about 2,500 psi, and overcome the force of the spring S, the collets will not disengage. For the operation of the thrust, bearing and release assembly 31, the reactive load from the stretching operation puts the shaft 30 in compression and the outer liner top 4 in tension during rotation of the work string. The stretching of the tubular material (via the stretching mandrel 26) results from a pushing imparted to the stretching mandrel 26, as will be explained later in the disclosure. In the view seen in FIG. 4A, the operator can run the apparatus 2 via the attached assembly 31 into the well on the work string. The assembly 31 is a means for selectively attaching the work string to the liners (liner top 4 and liner 6) and is an integral part of the setting tool 8.

Figure 4B:
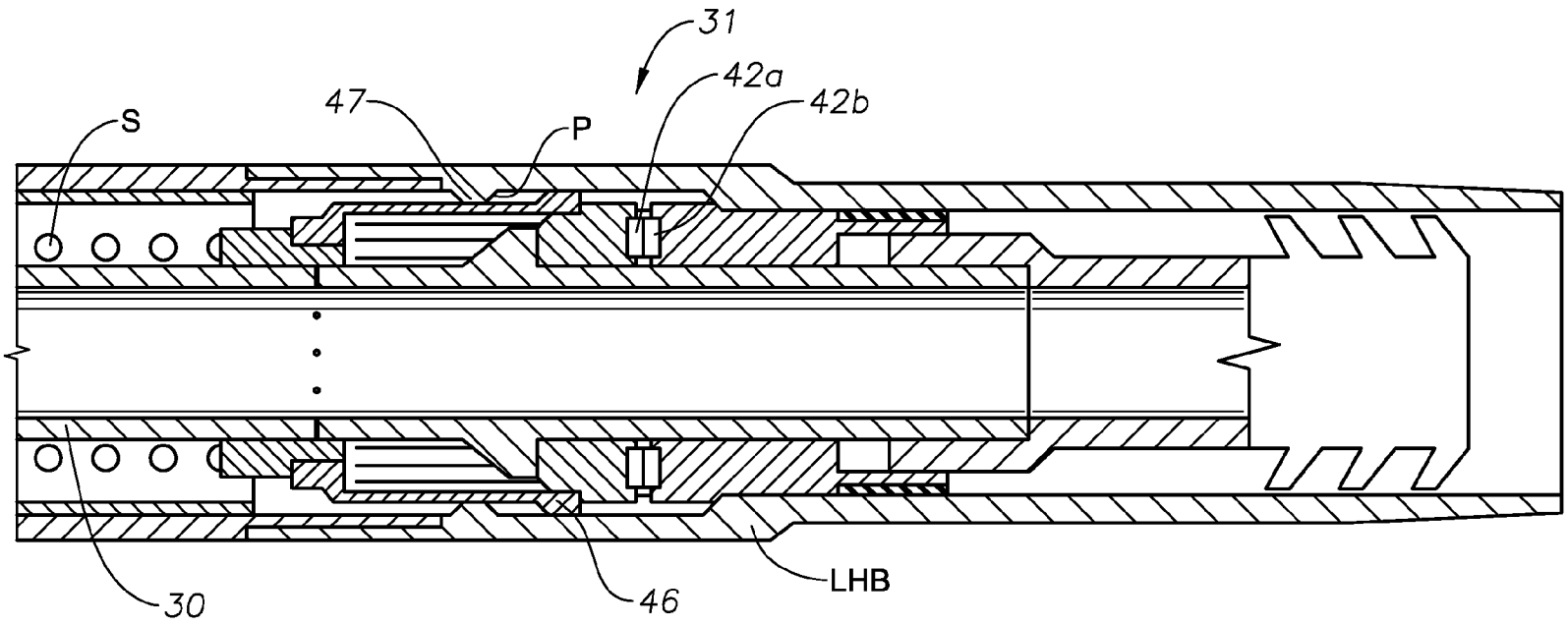
FIG. 4B is the thrust, bearing, and release assembly illustrated in FIG. 4A in a sequential view of the setting tool in compression.
Figure 4C:
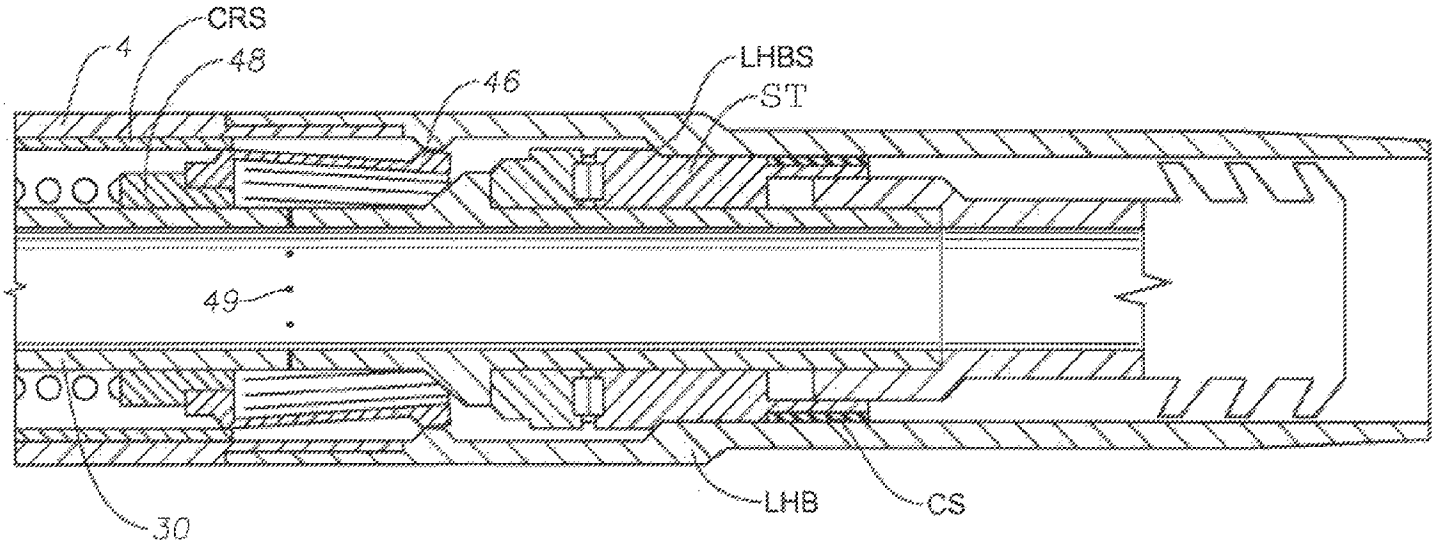
FIG. 4C is the thrust, bearing and release assembly illustrated in FIG. 4B in a sequential position depicting the thrust, bearing and release assembly as released from the liner top.

FIG. 4B is a sequential view of the position of the thrust, bearing and release assembly 31 of FIG. 4A with the setting tool in compression, such as when the casing shoe contacts the bottom of the open well bore at Total Depth. As understood by those of ordinary skill in the art, a casing shoe may be placed onto the end of a liner or casing for cementing purposes. FIG. 4C is a sequential view of the thrust, bearing and release assembly 31, with the assembly 31 released from the top liner 4 so that the work string and setting tool 8 may be pulled from the well after cementing and stretching operations are completed.

An overview of the operational sequence of the thrust, bearing and release assembly 31 follows. The top liner 4 and liner 6 are locked to the work string (which may be drill pipe) to run into the well via collets 46, thrust plate 40, and profiles P in the lower hanger body LHB as seen in FIG. 4A. In the position seen in FIG. 4A, the work string can be put in tension, compression, and torqued at will with the top liner 4 and liner 6 following in situ. Referring now to FIG. 4B, the sequential view of the setting tool in compression is illustrated. In this part of the sequence, the liner 6 has reached total depth (TD) of the wellbore. The setting tool 8 has now moved down relative to the surface a few inches longitudinally, independent of the liner top 4 (i.e. liner top 4 remains stationary), from the first position seen in FIG. 4A, compressing the spring 20 on the setting sleeve assembly 10 and closing the gap between the bearing inserts 42*a* and 42*b* as seen in FIG. 4B Next, the operator would cement the liner 6. For the cementing procedure, the operator calculates a volume of cement that is to be pumped from the surface into the top liner 4 and liner 6 via the work string. A dart is put in the work string separating drilling fluid from the cement and pumped down from the rig floor, landing in the cementing tool "T" and launching the wiper plug "WP", which pushes all cement from inside the top liner 4 and liner 6 into the annulus between the outer diameter of the top liner 4, liner 6 and the formation.

Referring now to FIG. 4C, the step of releasing the liner and stretching the top liner 4 will now be discussed. As well understood by those of ordinary skill in the art, with the dart and wiper plug "WP" at the liner shoe (not shown), pressure builds quickly. With fluid pressure pumped into the inner bore of the work string and the inner bore of the lower shaft 30, the collets 46 disengage via the pressure from the pump acting on the piston 48, from the inner work string via port holes 49. The piston 48 moves upward relative to the surface. A concentrically placed collet retaining sleeve CRS within the setting tool 8 is provided. With relative movement between the collet retaining sleeve CRS and the collets 46, the collets 46 are compressed. Also in one embodiment, pressure on the piston causes relative movement between the piston/attached collets and the lower shaft. The collet retaining sleeve CRS is threaded to the coupling "C" and is adjacent to the bottom centralizer bushing. There may be 20 degree upsets on the legs of the collets which push the legs inward once inserted into the CRS.

Next, the operation may include setting the liner top 4 into intermediate casing string. The stretch via the stretching mandrel assembly 24 commences with rotation of the work string as previously described. As seen in FIG. 4C, friction from compressing the stator "ST" against the lower hanger body "LHB", and in particular shoulder "LHBS" will keep the stator "ST" from rotating. The stretching mandrel assembly 24 moves-up independently with rotation of the work string. Once the stretch is complete, the elastomer members are formed and slips embedded, the setting tool 8, lower shaft 30, collet retaining sleeve CRS, and cementing tool T can be retrieved by retrieving the work string.

Figure 5:
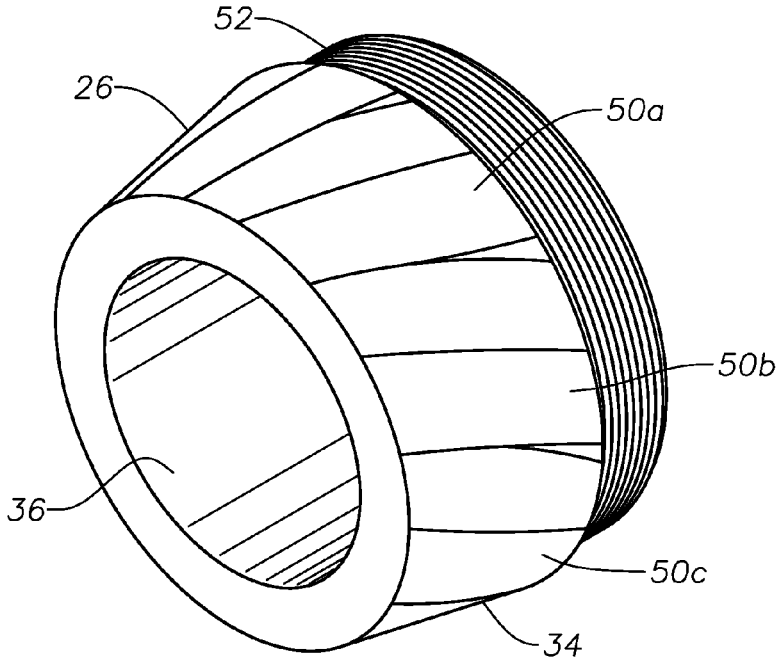
FIG. 5 is a perspective view of one embodiment of the stretching mandrel of this disclosure.

FIG. 5 is a perspective view of one embodiment of the stretching mandrel 26 of this disclosure. As noted earlier, the outer portion 34 of the stretching mandrel 26 is generally wedge shaped. More specifically, the outer portion 34 contains a series of individual helical, wedge shaped profiles. FIG. 5 depicts profiles, as for instance the helical, wedge shaped profiles 50*a*, 50*b*, 50*c*. FIG. 5 further depicts the inner bore 36 and the external thread means 52 that will threadedly make-up to the case housing 32.

Figure 6A:
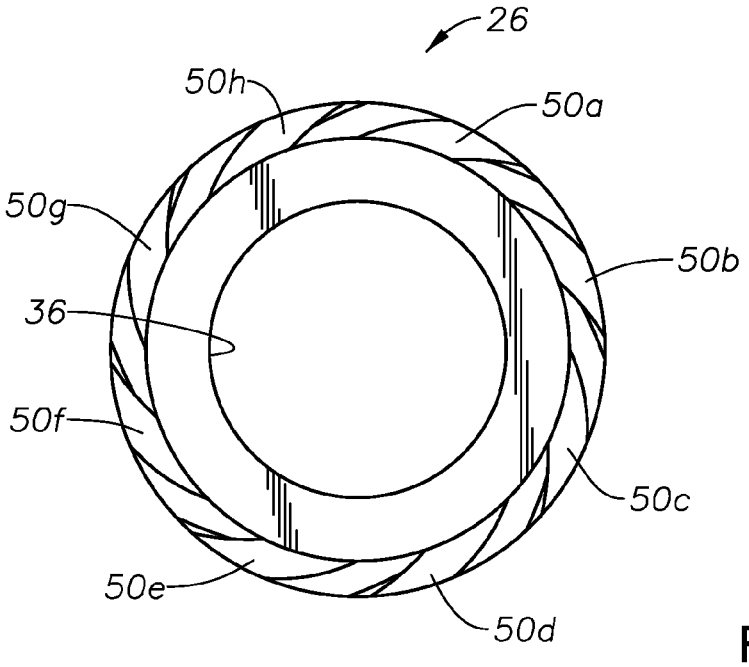
FIG. 6A is a front view of the stretching mandrel seen in FIG. 5.
Figure 6B:
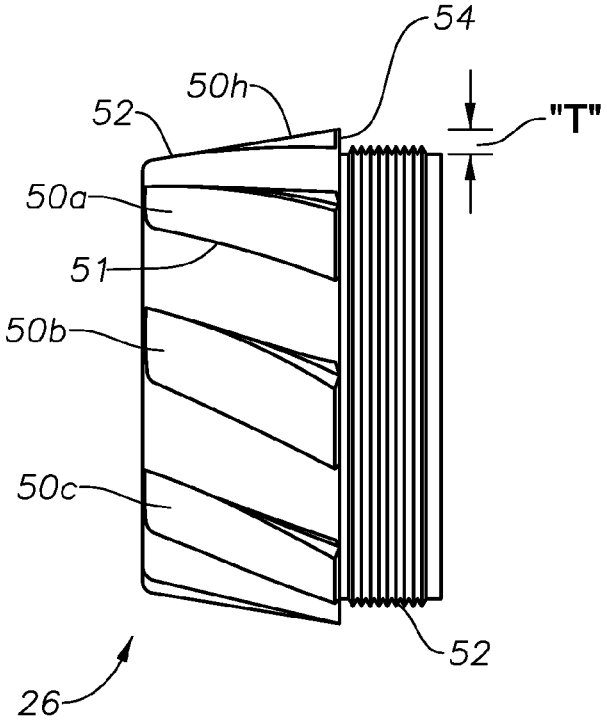
FIG. 6B is a side view of the stretching mandrel seen in FIG. 5.

Referring now to FIG. 6A, a front view of the stretching mandrel 26 seen in FIG. 5 will now be described. The view of FIG. 6A depicts the inner bore 36, as well as the helical wedge shaped profiles 50*a*, 50*b*, 50*c*, 50*d*, 50*e*, 50*f*, 50*g*, 50*h*. It should be understood that while eight (8) wedge shaped profiles where shown in a preferred embodiment, either more or less profiles may be incorporated into the design. FIG. 6B is a side view of the stretching mandrel 26 seen in FIG. 6A. The view of FIG. 6B depicts the conical, helical contour of the wedge shaped profiles 50*a*, 50*b*, 50*c*, (for instance, the helical contour 51). The thickness of the individual helical profile increases along its length; hence, the wedge shape. Thus for example in profile 50*h*, the helical profile increases from the top end (52) of a profile to the bottom end 54 of a profile. As can be seen in FIG. 6B, the thickness increases from zero at the top end 52 to the thickness "T" at the bottom end 54.

Figure 7A:
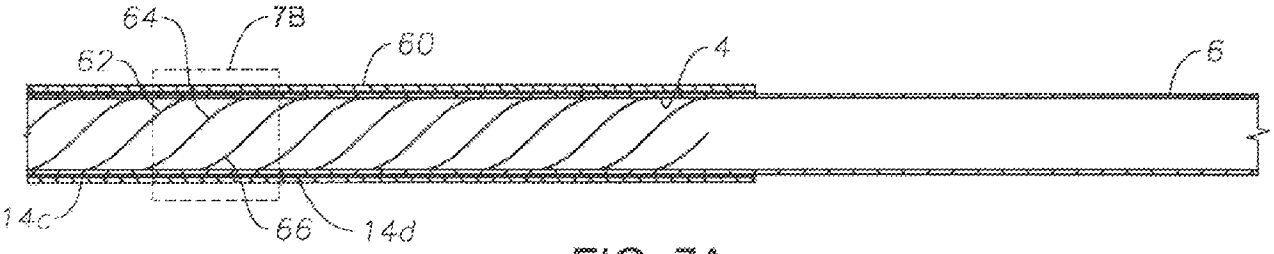
FIG. 7A is cross-sectional view of the top liner and liner set in a casing.

Referring now to FIG. 7A, a partial cross-sectional view of the liner top 4 and liner 6 set in a casing string 60 will now be described. In the view of FIG. 7A, the setting tool 8 has already been retrieved from the well. Hence, the elastomer banded members 14*c*, 14*d* have been force formed and molded into the extrusion gap. Note that the extrusion gap is formed from the difference of the inner portion of the casing 60 and the groove formed on the outer portion of the liner top 4 after the stretching mandrel 26 has been axially moved forward (i.e. upward) in the well. FIG. 7A also depicts the helical protrusions formed on the inner portion of the liner top 4. For instance, seen in FIG. 7A is the protrusions 62, 64, 66 that were formed as the stretching mandrel axially moved upward as previously noted.

Figure 7C:
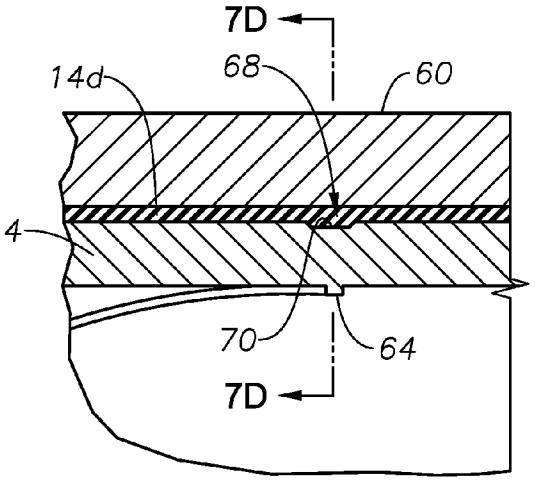
FIG. 7C is an enlarged view of the detail "7C" seen in FIG. 7B.
Figure 7B:
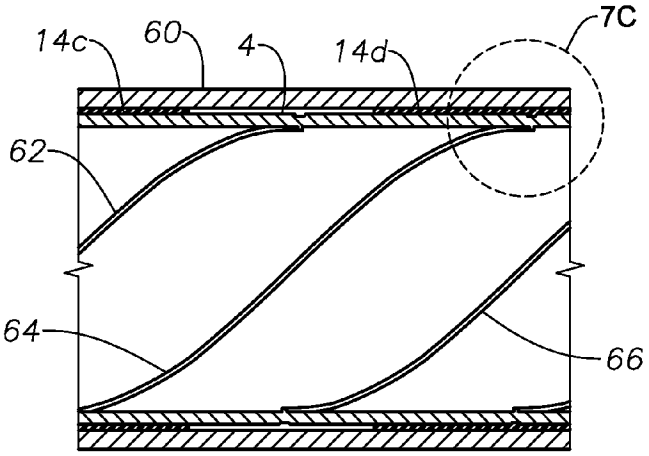
FIG. 7B is an enlarged view of the detail "7B" seen in FIG. 7A.
Figure 7D:
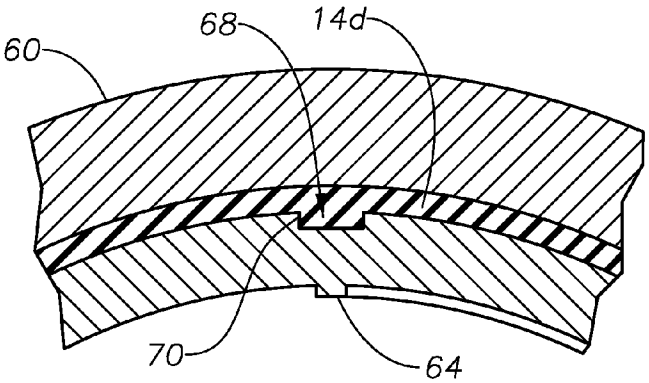
FIG. 7D is a cross-sectional view taken along line "7D" of FIG. 7C.

FIG. 7B is a cross-sectional view of the liner top 4 and casing 60 taken from detail "7B" of FIG. 7A. FIG. 7B illustrates the helical protuberance 62, 64, 66 formed on the inner portion of the top liner 4. FIG. 7C is an enlarged view of the detail "7C" seen in FIG. 7B, wherein the elastomer has filled the extrusion gap, seen generally at 68, wherein the groove 70 on the outer portion of the top liner 4 and the inner surface of the casing string 60 forming the extrusion gap 68. Additionally, FIG. 7C includes the helical protuberance 64 on the inner portion of the liner top 4 which was also formed during the stretching mandrel 26 moving axially, as previously described. These protuberances serve to increase the collapse resistance of the liner top after cold working the metal. FIG. 7D is a cross-sectional view taken along the line "7D" seen in FIG. 7C. FIG. 7D depicts the elastomer 14*d* filled variable extrusion gap 68 along with groove 70.

Figure 8:
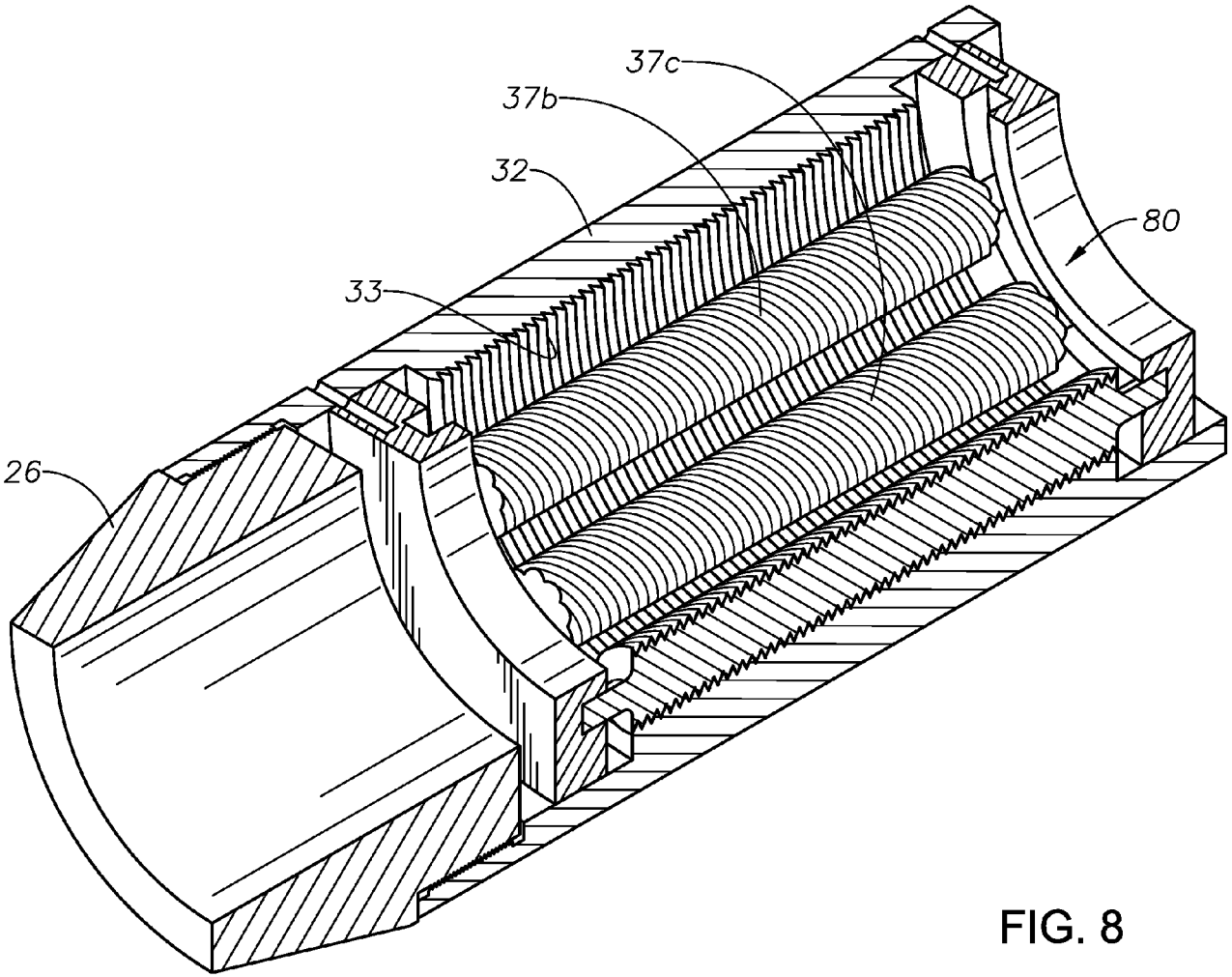
FIG. 8 is a partial perspective view of a planetary roller gear assembly.

With respect to the planetary roller gear member 28 previously described, one preferred embodiment of the planetary roller gears of the present disclosure will now be discussed with reference to the partial perspective view of FIG. 8. Planetary roller gears, seen generally at 80, suitable for use with the disclosed embodiments are illustrated in FIG. 8, and wherein planetary roller gears 80 are commercially available from Creative Motion Control under the name Roller Screw. The planetary roller gears 80 will provide power generating means, operatively attached to the screw shaft 22 (not shown here), for powering axial movement to the stretching mandrel 26 along the screw shaft during rotational movement. The stretching mandrel 26 is shown attached to the roller nut case housing 32. The power generating means includes the planetary roller gear assembly 80 operatively associated with the stretching mandrel 26. As seen in FIG. 8, the roller gears 37*b* and 37*c* are depicted, and wherein the roller gears are operatively configured to cooperate and engage the threaded inner portion 33.

Figure 9A:
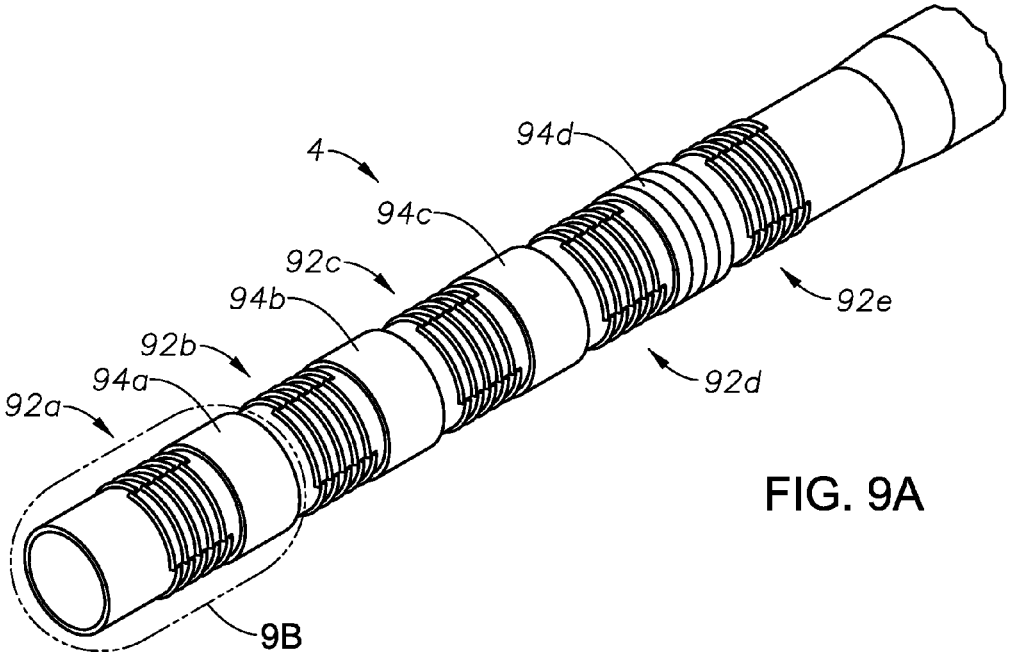
FIG. 9A is a perspective view of the top liner embodiment having slip members and elastomers.

FIG. 9A is a perspective view of the liner top embodiment having slip members. More specifically, the embodiment shown in FIG. 9A contains a liner top 4 that includes a plurality of slip bands 92*a*, 92*b*, 92*c*, 92*d*, 92*e*. As shown, the banded elastomers are also included, namely elastomer bands 94*a*, 94*b*, 94*c*, 94*d*. In the embodiment of FIG. 9A, the individual elastomer band 94*d* contains a plurality of elastomer ribs spaced a short distance apart, and wherein the individual elastomer ribs forming the elastomer band 94*d* are, in one embodiment, 0.375 inches apart. Also, sides of the individual ribs may be formed at an angle relative to the liner top 4. Regarding the slip bands, each slip contains a row of spikes (also referred to as teeth or slip wickers) that may be hardened at the tips. The spikes may be machined on the entire circumference or with segmented arc lengths as specifically shown in FIGS. 9A and 9B.

Figure 9B:
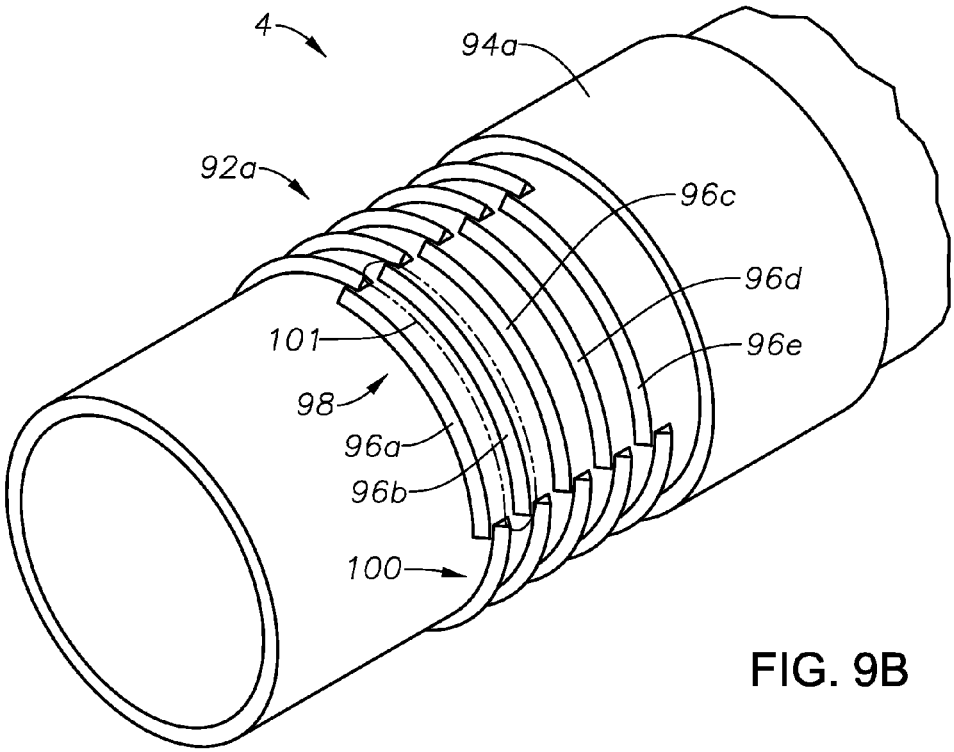
FIG. 9B is an enlarged view of one of the slip members seen in detail "9B" of FIG. 9A.

Referring now to FIG. 9B, an enlarged view of the slip member 92*a* seen in detail "9B" of FIG. 9A will now be described. More specifically, slip member 92*a* contains circumferential rows of spikes (i.e. teeth), for instance rows 96*a*, 96*b*, 96*c*, 96*d*, 96*e*. In the embodiment shown in FIGS. 9A and 9B, the individual rows are segmented into four arc lengths about the top liner 4, wherein each segmented arc length covers approximately a 90 degree phase such as segments 98, 100. In the embodiment shown in FIGS. 9A and 9B, the individual segmented arc lengths are offset from each other. The circle 101 depicts a segmented arc length, which may provide lower forging force per revolution than with circumferential spikes. In an alternate embodiment, the individual rows of spike may be continuous.

Figure 10B:
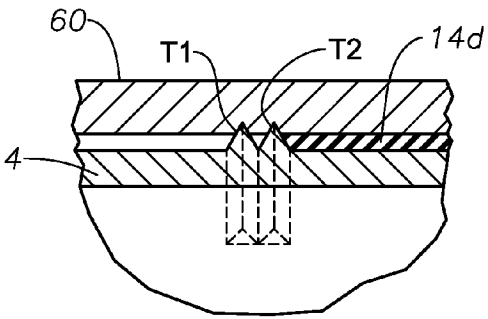
FIG. 10B is an enlarged view of the detail "10B" seen in FIG. 10A depicting individual slip teeth engaging the casing.
Figure 10A:
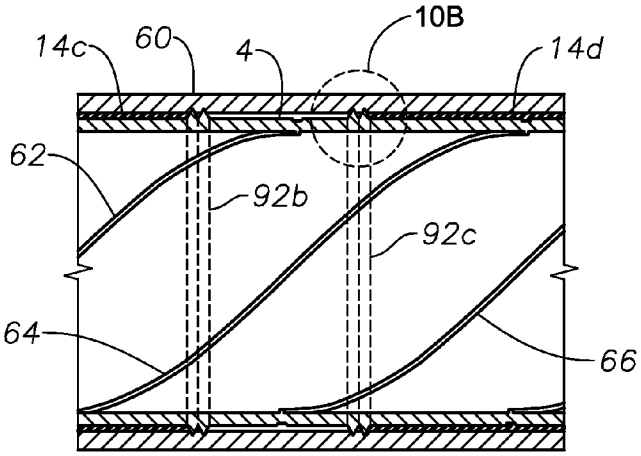
FIG. 10A is a cross-sectional view of the liner top embodiment having slip members set in the casing.

Referring now to FIG. 10A, which is a cross-sectional view of the liner top 4, the embodiment having slip members set in the casing will now be described. More specifically, the liner top 4 is shown with the protrusions 62, 64, 66 formed and the elastomer members 14*c*, 14*d* formed on the outer surface of the liner top 4 as previously described. FIG. 10A also depicts the slip bands 92*b*, 92*c*, wherein the slip bands 92*b*, 92*c* are embedded in the inner surface of the liner top 4.

Figure 10D:
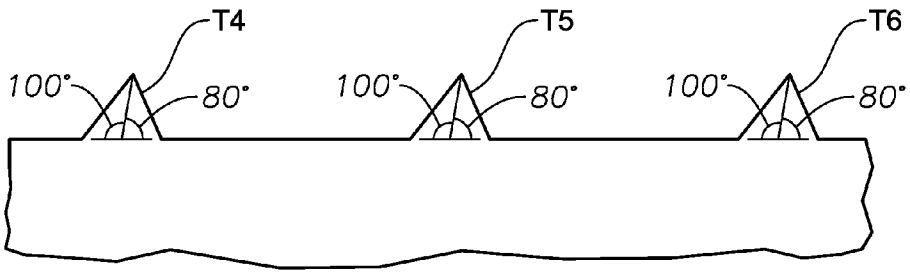
FIG. 10D is an enlarged detail of another embodiment of the slip teeth.
Figure 10C:
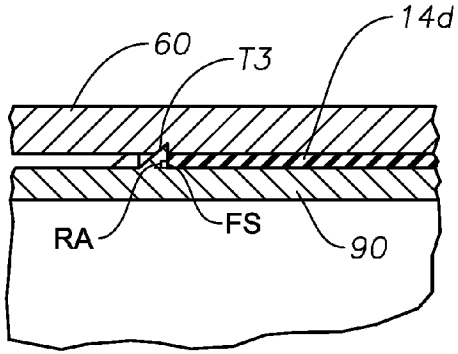
FIG. 10C is an enlarged detail of the slip teeth.

FIG. 10B is an enlarged view of the detail "10B" seen in FIG. 10A, wherein FIG. 10B depicts the individual slip teeth engaging the casing. More specifically, FIG. 10B depicts the liner top 4 disposed within the casing 60 along with the elastomer member 14*d* sealingly contacting the inner surface of the casing 60. FIG. 10B depicts the tooth T1 and the tooth T2 embedded in the inner surface of the casing 60 which anchors the liner top 4 to the casing 60. The profiles of the individual teeth, as seen in FIGS. 10A and 10B, are equilateral triangles. Note that the top portion of the elastomer member 14*d* abuts the slip teeth T2. FIG. 10C is an alternate embodiment of an individual slip tooth, wherein in the embodiment of FIG. 10C, the tooth T3 is oriented with a right angle arrangement. The right angle "RA" is oriented such that the flat surface "FS" will abutt the elastomer when the teeth (such as tooth T3) are embedded in the inner casing wall. There is limited volume in the extrusion gap between the liner top and intermediate casing after the stretch. The elastomer has a greater volume than the extrusion gap and while some of the rubber gets compressed, the remainder of it is forced into the open gap area between the elastomer bands. Also, some of the elastomer may go into the outer diameter groove which is opposite the protuberance. In one embodiment, the volume is carefully calculated to allow voids and the rubber is machined so pressure may push the rubber into any micro gap that exists at the surface of the intermediate casing. An aspect of one of the disclosed embodiments is the geometry of each slip tooth can provide a desirable attribute once embedded into the intermediate casing. A slip tooth with a symmetrical apex having a cross-section described as an equilateral triangle, as shown in FIGS. 10A, 10B, will provide the same shearing strength without regard to any forces acting perpendicular to it. A change in geometry of the slip tooth, which has a cross-section described as a right angle RA, as shown in FIG. 10C, is directionally dependent and therefore provides shearing resistance in only one perpendicular direction. In yet another disclosed embodiment, FIG. 10D depicts an embodiment of individual slip teeth, and more particularly, slip teeth T4, T5, and T6. As shown in FIG. 10D, the cross-sectional area of the slip teeth T4, T5 and T6 is a triangle which has a line drawn from the base mid-point to the apex of the triangle; the mid-point line forms an 80 degree angle (as shown) with a complementary 100 degree angle. The 80 degree angle is sometimes referred to as the angled apex. In one preferred embodiment, the angled apex is between 90 degrees and 50 degrees, and in the most preferred embodiment, the angled apex is 80 degrees. In this way, the slip teeth shown in FIG. 10D may optimally engage the inner casing at a suitable angle of attack when the stretching mandrel stretches the liner top as previously described. An operator may choose the geometry of the slip teeth which best suits the operators need in the subject well.

Figure 11:
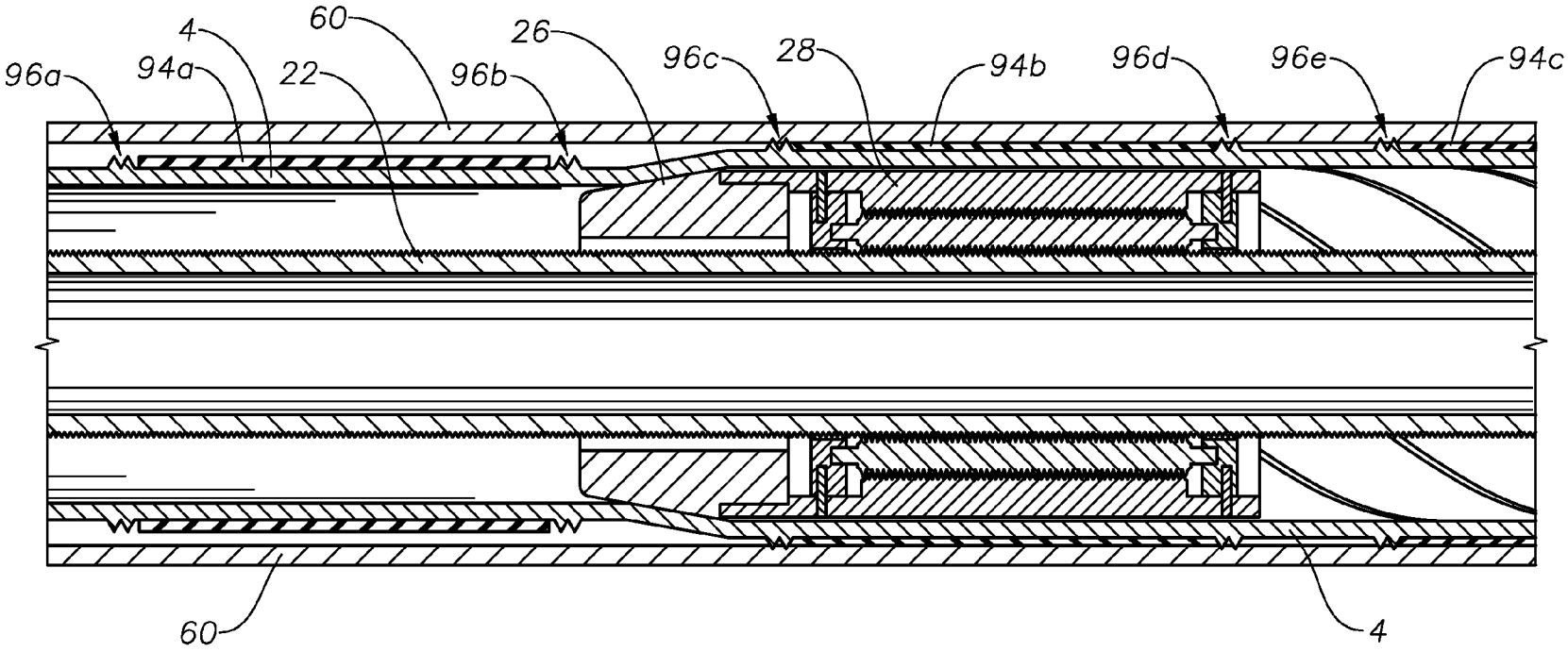
FIG. 11 is a partial cross-sectional view of the liner top with the stretching mandrel disposed therein.

FIG. 11 is a partial cross-sectional view of the liner top 4 when containing a plurality of slip bands. More specifically, FIG. 11 depicts the stretching mandrel 26 in the process of moving forward (i.e. upward towards the surface). FIG. 11 illustrates the stretching mandrel 26 engaging the inner portion of the liner top 4. As previously described, the stretching mandrel is threadedly connected to the planetary roller gear member 28, wherein the planetary roller gear member 28 is threadedly engaged with the threaded shaft 22.

In the embodiment illustrated in FIG. 11, liner top 4 contains slip bands 96*a*, 96*b*, 96*c*, 96*d*, 96*e* as well as elastomer bands 94*a*, 94*b*, 94*c*. Note that the slip bands seen in FIG. 11 are the equilateral triangle teeth previously described. The slip bands 96*c*, 96*d*, 96*e* have been set and anchored into the inner portion of the casing 60, and the elastomer bands 94*b*, 94*c* are sealingly engaging the inner portion of the casing 60 as previously described. As per the teaching of one embodiment of this disclosure, continued advancement of the stretching mandrel will in turn engage the slips 96*a*, 96*b* as well as elastomer band 94*a* with the inner portion of the casing 60.

Figure 12:
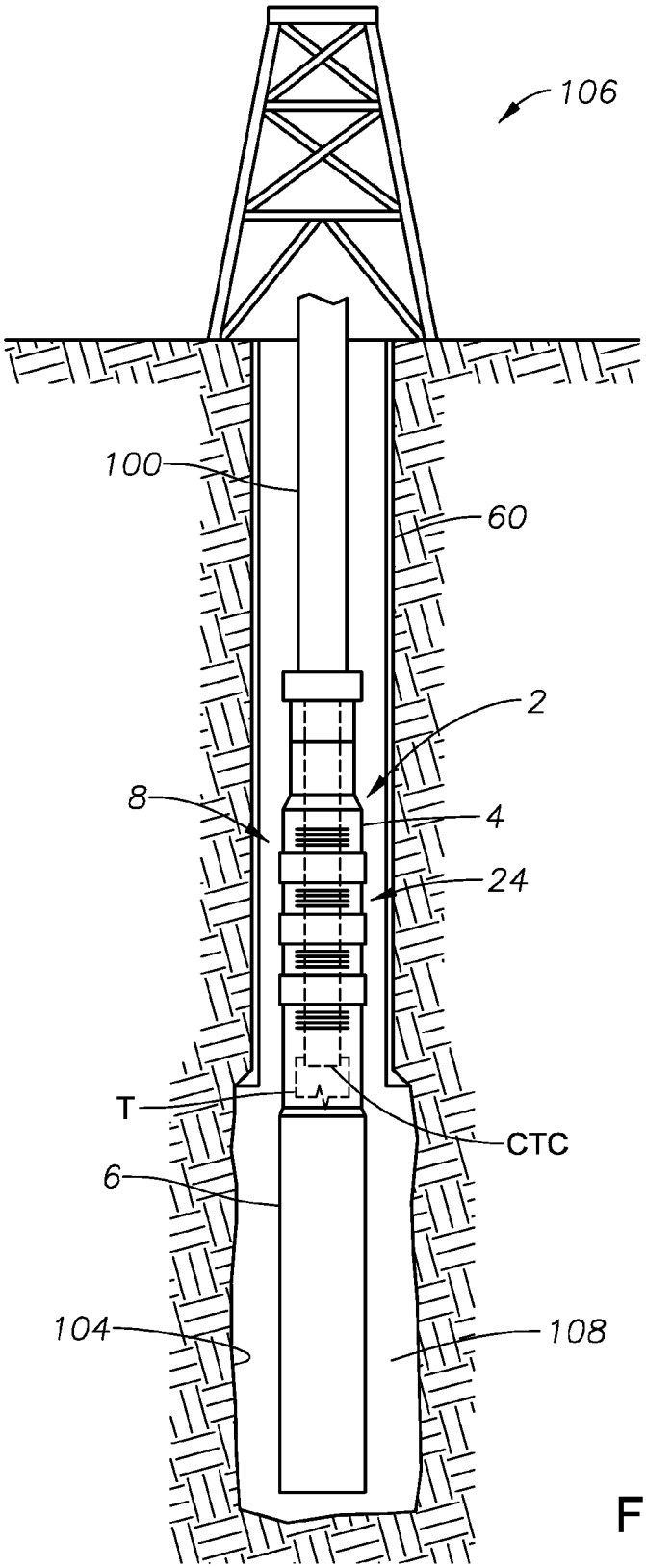
FIG. 12 is a schematic illustration of the apparatus attached to a work string and disposed within a well.

Referring now to FIG. 12, a schematic illustration of the apparatus 2 attached to a work string 100 and disposed within a well will now be described. More specifically, the work string 100 is disposed within a casing string 60, with a bore hole 104 extending from the casing string 60. The apparatus 2 includes the liner top 4 attached to the liner 6. The setting tool 8 is releasably attached to the top liner 4. The stretching mandrel assembly 24, and the thrust, bearing and release assembly 31 will be incorporated as part of the setting tool 8 as previously described. At the end of the setting tool 8 will be the cement tool connection CTC and cementing tool T. As very well understood by those of ordinary skill in the art, the well may be associated with a rig 106 at the surface, and the rig will have all the necessary equipment to drill, log, cement and case the well. The equipment on the rig 106 may include pumps, lifting equipment, top drives, and rotary means. A rotational force imparted to the work string 100 will turn the stretching mandrel 26 as previously mentioned.

In operation, the apparatus 2 is concentrically placed within the casing 60 via the work string 100. The setting tool is released from the liner top 4 and liner 6, and the work string 100 is rotated so that the roller screw is rotated and the operation further includes moving the stretching mandrel 26 forward (i.e. upward), creating a protuberance on the inner portion of the liner top 4 with the helical wedge profiles, forming helical grooves on the outer portion of the liner top 4, molding the banded elastomer into a variable extrusion gap formed between the inner portion of the casing and the helical groove on the outer portion of the liner top 4, and sealingly engaging the force formed and molded elastomer with the inner portion of the casing 60. In the step of placing the apparatus 2 within the casing 60, the operation may include pumping cement through the work string and through the apparatus 2 so that the cement exits a distal end of the liner and cementing the wellbore by providing the cement to an annular area 108 formed between the liner 6 and the wellbore 104. The operation may further include pulling the work string 100 and attached setting tool 8 from the casing 60.

An aspect of one embodiment is the ability to rotate and reciprocate the liner top 4/liner 6 during deployment, which is advantageous for getting to bottom in tight holes as well as a good cement job when running a liner. The metal forming mechanism functions with work string 100 rotation only after the release mechanism is disengaged. With the release mechanism is still engaged, work string rotation will be transferred through the apparatus 2 and to the liner 6.

Although the present invention has been described in considerable detail with reference to certain preferred versions thereof, other versions are possible. Therefore, the spirit and scope of the appended claims should not be limited to the description of the preferred versions contained herein.

I claim:

1. An apparatus for setting a liner in a wellbore, the wellbore containing a casing string partially disposed therein, the apparatus attached to a work string placed in the wellbore, the apparatus comprising:

a setting tool attached to the work string, said setting tool having attached thereto a stretching mandrel containing a plurality of helical wedge profiles on an outer surface of said stretching mandrel;

a liner top releasably attached to the setting tool, said liner top containing a plurality of banded elastomer sheaths positioned on an outer portion of said liner top, and wherein said stretching mandrel is concentrically placed within said liner top;

a screw shaft operatively attached to said setting tool, the screw shaft configured to generate an axial movement of said stretching mandrel so that a rotational movement imparted to said work string causes a forward, rotational movement of said stretching mandrel so that said helical wedge profiles form helical protuberances on an inner portion of said top liner and helical grooves are formed on the outer portion of said liner top which sealingly engages with an inner surface of the casing string, wherein said elastomer sheaths flow into said helical grooves and engage with the inner surface of the casing string;

a power generating means operatively attached to said screw shaft, the power generating means configured for powering axial movement to said stretching mandrel along said screw shaft during rotational movement, wherein said power generating means includes a planetary roller gear assembly operatively associated with said stretching mandrel.

2. The apparatus of claim 1 further comprising:

a cement tool connector operatively attached to the setting tool, the cement tool connector configured to provide an outlet to a cement slurry pumped through the work string and into an annulus formed between the liner and the wellbore.

3. The apparatus of claim 1 wherein said setting tool further includes a releasing assembly detachably connected to the liner, the releasing assembly configured to selectively release said setting tool from said liner top and liner in the wellbore.

4. An apparatus for setting a liner in a wellbore, the wellbore containing a casing string partially disposed therein, the apparatus attached to a work string placed in the wellbore, the apparatus comprising:

a setting tool attached to the work string, said setting tool having attached thereto a stretching mandrel including a plurality of helical wedge profiles on an outer surface of said stretching mandrel;

a liner top releasably attached to the setting tool at a proximal end and attached to the liner at a distal end, wherein said stretching mandrel is concentrically placed within said liner top;

a plurality of elastomer ribs positioned on an outer portion of said liner top;

a plurality of slip bands circumferentially positioned about the outer portion of said liner top;

a screw shaft operatively attached to said setting tool, the screw shaft configured to generate an axial movement of said stretching mandrel so that a rotational movement imparted to said work string causes a forward, rotational movement of said stretching mandrel so that said helical wedge profiles form helical protuberances on an inner portion of said liner top and helical grooves are formed on the outer portion of said liner top which sealingly engages with an inner surface of the casing string, and said slip band is forged and anchors with the inner surface of the casing string with the axial movement of said stretching mandrel;

a power generating means operatively attached to said screw shaft, the power generating means configured for powering axial movement to said stretching mandrel along said screw shaft during rotational movement, the power generator including a planetary roller gear assembly operatively associated with said stretching mandrel.

5. The apparatus of claim 4 wherein said slip bands comprise an angled apex between 90 degrees and 50 degrees.

6. The apparatus of claim 4 wherein said setting tool further includes a releasing assembly detachably connected to the liner, the releasing assembly configured to selectively release said setting tool from said liner top and liner in the wellbore.

7. A method of anchoring and sealing a liner to a casing, wherein the casing is positioned within a wellbore and a work string is concentrically placed within the wellbore, the method comprising the steps of:

a) providing an apparatus concentrically placed within the casing, said apparatus including a setting tool attached to the work string, said setting tool having attached thereto a stretching mandrel, the stretching mandrel including an outer surface having a plurality of helical wedge profiles; a liner top releasably attached to the setting tool at a proximal end and attached to the liner at a distal end, said liner top including a plurality of banded elastomer sheaths positioned on an outer portion of said liner top and a plurality of slips positioned on the outer portion of said top liner, and wherein said stretching mandrel is concentrically placed within an inner portion of said top liner; a screw shaft operatively attached to said setting tool, the screw shaft configured to generate an axial movement of the stretching mandrel so that a rotational movement imparted to the work string causes a forward, rotational movement of the stretching mandrel so that the helical wedge profiles form helical protuberances on the inner portion of the top liner and helical grooves on the outer portion of the top liner which sealingly engages with an inner surface of the casing, wherein the banded elastomer sheaths flow into the helical grooves and engage with the inner surface of the casing; a power generating means operatively attached to the screw shaft, the power generating means configured to provide axial movement to the stretching mandrel along the screw shaft during rotational movement, wherein the power generating means includes a planetary roller gear assembly operatively associated with the stretching mandrel;

b) releasing the setting tool from the liner top;

c) rotating the work string so that said roller screw is rotated;

d) moving said stretching mandrel forward;

e) creating a protuberance on the inner portion of said liner top with said helical wedge profiles;

f) forming the helical groove on said outer portion of said liner top;

g) molding said banded elastomer sheaths into a variable extrusion gap formed between the inner portion of the casing and the helical groove on the outer portion of said liner top;

h) sealingly engaging the molded elastomer sheaths with the inner portion of the casing;

i) forging said slips into the inner portion of the casing;

j) anchoring said slips with the inner portion of the casing.

8. The method of claim 7 wherein after the step (a) of providing the apparatus within the casing, the method includes the steps of:

a1) pumping a cement through the work string and through the apparatus so that the cement exits a distal end of the liner;

a2) cementing the wellbore by providing the cement to an annular area formed between the liner and the wellbore.

9. The method of claim 8 further comprising the step of:

k) pulling the work string and attached setting tool from the casing.

* * * * *